US008283966B2

(12) United States Patent
Liu

(10) Patent No.: US 8,283,966 B2
(45) Date of Patent: Oct. 9, 2012

(54) INTEGRATOR CIRCUIT

(75) Inventor: Tung-Jung Liu, Taichung County (TW)

(73) Assignee: Actron Technology Corporation, Taoyuan County (TW)

( * ) Notice: Subject to any disclaimer, the term of this patent is extended or adjusted under 35 U.S.C. 154(b) by 146 days.

(21) Appl. No.: 12/957,544

(22) Filed: Dec. 1, 2010

(65) Prior Publication Data

US 2012/0038408 A1 Feb. 16, 2012

(30) Foreign Application Priority Data

Aug. 13, 2010 (TW) ..... 99127151 A

(51) Int. Cl.
*G06G 7/18* (2006.01)

(52) U.S. Cl. ..... 327/337

(58) Field of Classification Search ..... 327/336, 327/337

See application file for complete search history.

(56) References Cited

U.S. PATENT DOCUMENTS 6,150,851 A * 11/2000 Ohmi et al. ..... 327/91

* cited by examiner

*Primary Examiner* — Lincoln Donovan
*Assistant Examiner* — William Hernandez
(74) *Attorney, Agent, or Firm* — Rosenberg, Klein & Lee

(57) ABSTRACT

An integrator circuit is provided in the present invention, which utilizes a first capacitor and a first switching unit to sample an input signal and carries out distribution of charges between the first capacitor and a second capacitor. The second capacitor is larger than the first capacitor in capacitance. The integrator circuit transmits the charges stored in the second capacitor to a node of the first capacitor which is coupled to a ground previously. Accordingly, a direct current voltage level of the first capacitor may increase, facilitating an increase in a direct current voltage level at the second capacitor. Thereby, the accuracy and linearity of the integrator circuit may improve.

10 Claims, 3 Drawing Sheets

INTEGRATOR CIRCUIT

BACKGROUND OF THE INVENTION

1. Field of the Invention

The present invention relates to an integrator circuit, and more particularly, to an integrator circuit that has a high resolution and a small phase difference.

2. Description of Related Art

An integrator is a commonly used analog circuit for performing a mathematical operation of integration. Typically, a voltage integrator is formed by an electric circuit composed of capacitors and resistors. Since a current passing through a capacitor is relative to a rate of voltage change, i.e., a result of differentiating voltage at a time, a voltage across the capacitor is considered as a result of the operation of integration for an input voltage and a voltage across the resistor is considered as a differential result for the input voltage. In the related art, an operational amplifier is often applied in an integrator circuit or a differentiator circuit for adjusting the input impedance and the output impedance of the integrator circuit.

Another well-known low frequency integrator is equipped with an Analog to Digital Converter (ADC) to convert an analog signal to a digital signal before the operation of integration is performed. However, the accuracy of results obtained from the integrator circuit is restricted by the resolution of the ADC. Even though the accuracy of the integrator can be enhanced by utilizing the ADC of a higher resolution, the associated cost for the integrator circuit increases accordingly. In addition, the conventional integrators generally require a low-pass filter to filter out high-frequency portions of signals before the performance of the operation of the integration. However, for the lower-frequency portions of the signal to be filtered out the integrators require larger capacitance, increasing overall manufacturing costs of such integrators and causing larger difference in phase and low frequency oscillation destabilizing system control.

SUMMARY OF THE INVENTION

The present invention provides an integrator circuit which utilizes the charge distribution principle of capacitors to implement a low-frequency hybrid integrator circuit. The integrator circuit of the present invention is associated with a higher resolution and a lower difference in phase with reduced manufacturing cost.

The present invention is directed to an integrator circuit which comprises a first energy storage component, a first switching unit, a second switching unit, and a second energy storage component. The first energy storage component is coupled between a first node and a second node. The first switching unit is coupled to the first node, an input terminal, the second node, and a ground terminal, for selectively electrically connecting the first node to the input terminal and the second node to the ground terminal. The second switching unit is coupled to the first node, the second node, and a third node, for selectively electrically connecting the first node to the third node and selectively transmitting a voltage at the third terminal to the second node. The second energy storage component is coupled between the third node and the ground terminal.

In one aspect of the present invention, when the first switching unit electrically connects the first node to the input terminal and the second node to the ground terminal, the second switching unit disconnects the first node from the third node.

In another aspect of the present invention, when the second switching unit electrically connects the first node to the third node and transmits the voltage at the first node (also at the third node) to the second node, the first switching unit disconnects the first node from the input terminal and the second node form the ground terminal.

In another aspect of the present invention, the first switching unit comprises a first switch and a second switch. The first switch is coupled between the first node and the input terminal. The second switch is coupled between the second node and the ground terminal. Herein, the first switch and the second switch are controlled by a first control signal.

In another aspect of the present invention, the second switching unit comprises a third switch, a first unit gain amplifier, and a fourth switch. The third switch is coupled between the first node and the third node. The input of the first unit gain amplifier is coupled to the first node. The fourth switch is coupled between the output of the first unit gain amplifier and the second node. Therein, the third switch and the fourth switch are controlled by a second control signal.

In another aspect of the present invention, as the aforementioned first control signal is enabled, the second control signal is disabled.

In another aspect of the present invention, the aforementioned integrator circuit further comprises a fifth switch coupled between the third node and the ground terminal. The above-mentioned first energy storage component in one implementation is a first capacitor. The second energy storage component in one implementation is a second capacitor, and the capacitance of the first capacitor is smaller than the capacitance of the second capacitor.

In another aspect of the present invention, the aforementioned integrator circuit further comprises an output buffer unit coupled between the third node and an output terminal. The output buffer unit comprises a second unit gain amplifier, a sixth switch, a third unit gain amplifier, and a third capacitor. The input of the second unit gain amplifier is coupled to the third node. The sixth switch has a terminal coupled to the output of the second unit gain amplifier. The input of the third unit gain amplifier is coupled to another terminal of the sixth switch and the output of the third unit gain amplifier is coupled to the output terminal. The third capacitor is coupled between the input of the third unit gain amplifier and the ground terminal.

In summary, the integrator circuit in accordance with the present technique utilizes the charge distribution principle of the capacitors to compress and store voltage signals into the capacitors, wherein the voltage signals is generated by having an input voltage sampled at each time interval, so that the linearity of the integrator circuit may increase. Moreover, the proposed integrator circuit in comparison with the conventional counterpart is associated with a higher accuracy, which is no longer restricted by the resolution of the ADC as the result. Furthermore, the integrator circuit may be associated with a reduced difference in the phase also.

In order to further the understanding regarding the present invention, the following embodiments are provided along with illustrations to facilitate the disclosure of the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1:
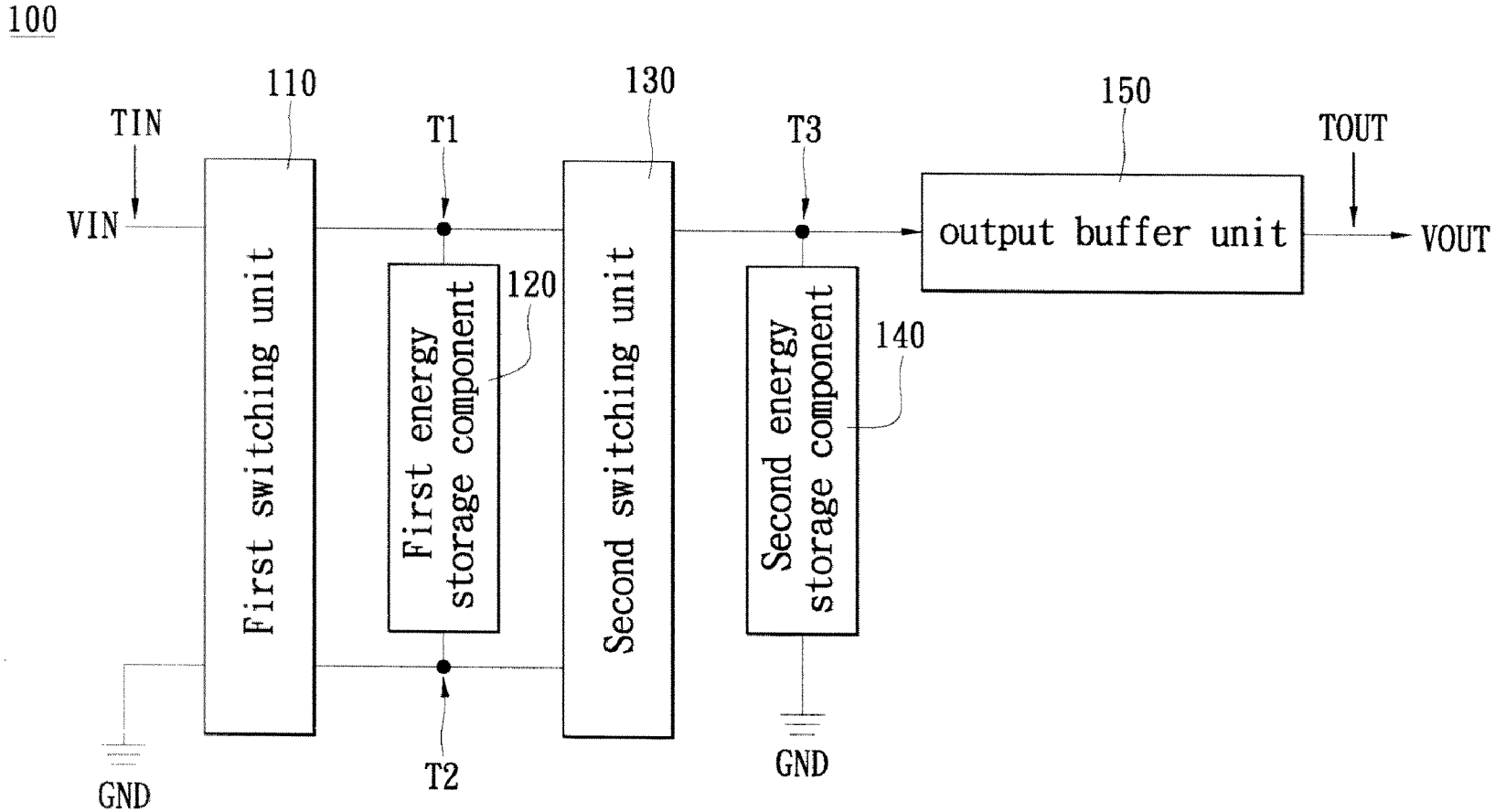
FIG. 1 illustrates a block diagram of an integrator circuit according to an embodiment of the present invention.

Please refer to FIG. 1, in which a block diagram of an integrator circuit according to an embodiment of the present invention is illustrated. The integrator circuit 100 comprises a first switching unit 110, a first energy storage component 120, a second switching unit 130, a second energy storage component 140, and an output buffer unit 150. The first energy storage component 120 is coupled between a first node T1 and a second node T2. The first switching unit 110 is coupled to the first node T1, an input terminal TIN, the second node T2, and a ground terminal GND for selectively electrically connecting the first node T1 to the input terminal TIN and the second node 12 to the ground terminal GND. The second switching unit 130 is coupled to the first node T1, the second node T2, and a third node T3, for selectively electrically connecting the first node T1 and the third node T3 and selectively transmitting a voltage at the third node T3 to the second node 12. The second energy storage component 140 is coupled between the third node T3 and the ground terminal GND. The output buffer unit 150 is coupled between the third node T3 and an output terminal TOUT.

When the first switching unit 110 electrically connects the first node T1 to the input terminal TIN and the second node T2 to the ground terminal GND, the second switching unit 130 is configured to disconnect the first node T1 from the third node T3. When the second switching unit 130 electrically connects the first node T1 to the third node T3 and transmits the voltage at the third node T3 to the second node T2, the first switching unit 110 is configured to disconnect the first node T1 from the input terminal TIN and the second node 12 from the ground terminal GND. The first switching unit 110 is used to primarily determine a sampling rate for sampling of an input signal VIN. When the first node T1 and the input terminal TIN are conducted (i.e., connected to each other) and the second node 12 and the ground terminal GND are conducted (i.e., connected to each other), the input signal VIN is sampled once. The voltage of the input signal VIN may be stored in the first energy storage component 120, and then the first switching unit 110 may stop the conduction between T1 and TIN and T2 and GND. The second switching unit 130 electrically connects the third node T3 to the first node T1 and transmits the voltage at the first node T1 (also at the third node T3) to the second node T2 so as to boost up an original voltage of the first energy storage component 120. Meanwhile, charges stored within the first energy storage component 120 may be distributed over the first energy storage component 120 and the second energy storage component 140 for boosting up the voltage at the third node T3, thereby achieving the effect of voltage integration.

Additionally, it is worth noting that the first switching unit 110 and the second switching unit 130 are mainly used for switching conduction paths. In one implementation, the first switching unit 110 may be a plurality of switches, multiplexers, or switching components, but is not limited thereto. The first energy storage component 120 and the second energy storage component 140 may be implemented by a single capacitor or a plurality of capacitors in parallel or series connections, but is not limited thereto. The output buffer unit 150 is mainly used to adjust the output impedance. In one implementation, the output buffer unit 150 is a buffering circuit or a gain amplifier, but is not limited thereto.

Figure 2:
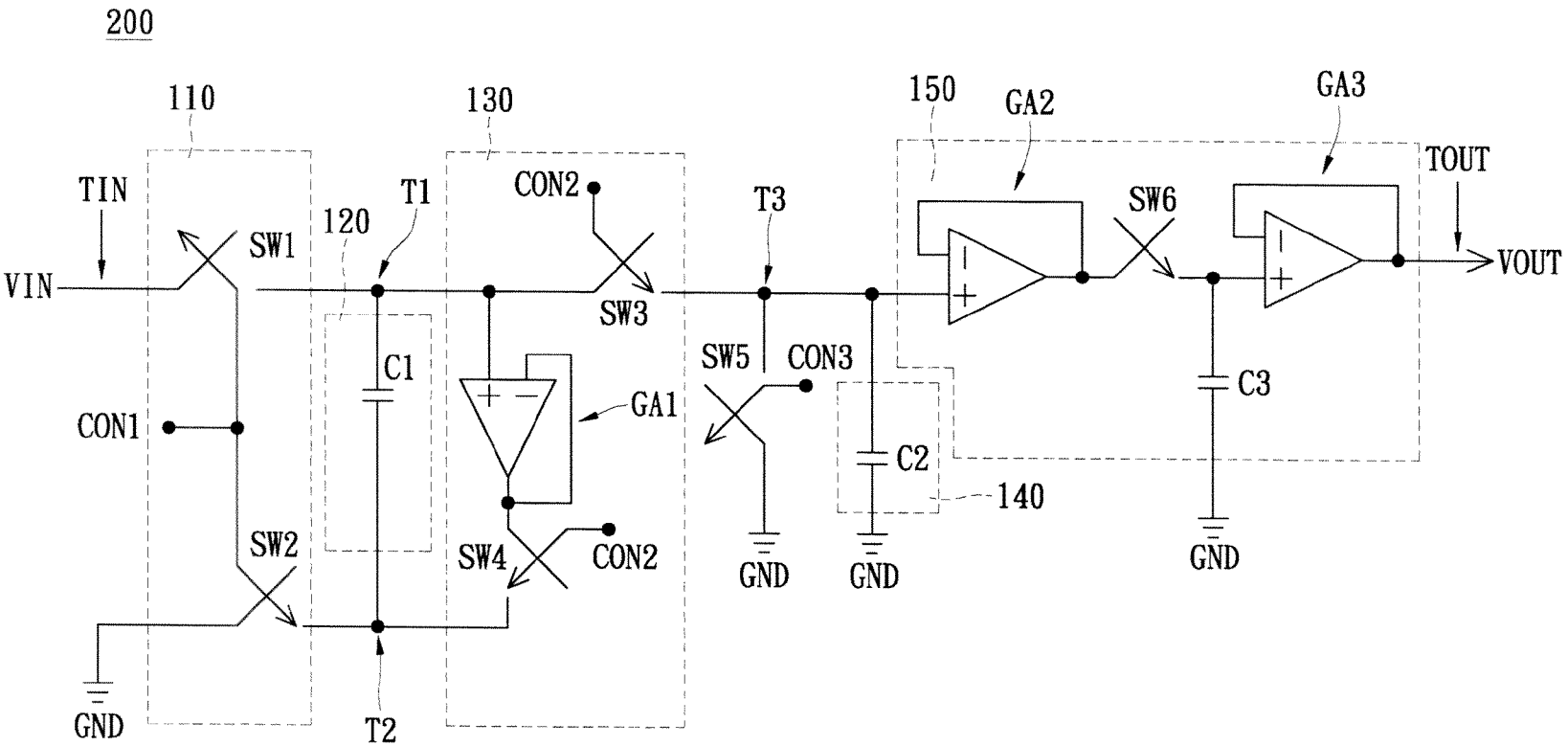
FIG. 2 illustrates a circuit diagram of the integrator circuit according to the embodiment of the present invention.

Any implementing details in accordance with the embodiment of the integrator circuit according to the present invention are further illustrated as following. Please refer to FIG. 2 in conjunction with FIG. 1. FIG. 2 illustrates a circuit diagram of the integrator circuit according to the embodiment of the present invention. In the integrator circuit 200 shown in FIG. 2, the first switching unit 110 comprises a first switch SW1 and a second switch SW2. The second switching unit 130 comprises a third switch SW3, a fourth switch SW4, and a first unit gain amplifier GA1. The first energy storage component 120 is implemented by a first capacitor C1 and the second energy storage component 140 is implemented by a second capacitor C2. The output buffer unit 150 comprises a second unit gain amplifier GA2, a third unit gain amplifier GA3, a sixth switch SW6, and a third capacitor C3. The integrator circuit 200 further comprises a fifth switch SW5 coupled between the third node T3 and the ground terminal GND, for transmitting the charges stored in the second capacitor C2 to the ground terminal GND so as to reset the integrator circuit 200.

The first capacitor C1 is coupled between the first node T1 and the second node T2. The second capacitor C2 is coupled between the third node T3 and the ground terminal GND. The first switch SW1 is coupled between the first node T1 and the input terminal TIN. The second switch SW2 is coupled between the second node T2 and the ground terminal GND. The third node SW3 is coupled between the first node T1 and the third node T3. The input of the first unit gain amplifier GA1 is coupled to the first node T1. The fourth switch SW4 is coupled between the output of the first unit gain amplifier GA1 and the second node T2. The second unit gain amplifier GA2 is coupled between the third node T3 and the sixth terminal SW6. The third unit gain amplifier GA3 is coupled between another terminal of the sixth switch SW6 and the output terminal TOUT. The first unit gain amplifier GA1, the second unit gain amplifier GA2, and the third unit gain amplifier GA3 are implemented by operational amplifiers with negative feedback, but are not limited thereto. Moreover, it is worth noting that the connecting relationship of the aforementioned components includes direct connection, indirect connection, or a combination of the direct connection and the indirect connection, but is not limited thereto as long as the transmission function for the electronic signals can be achieved.

Figure 3:
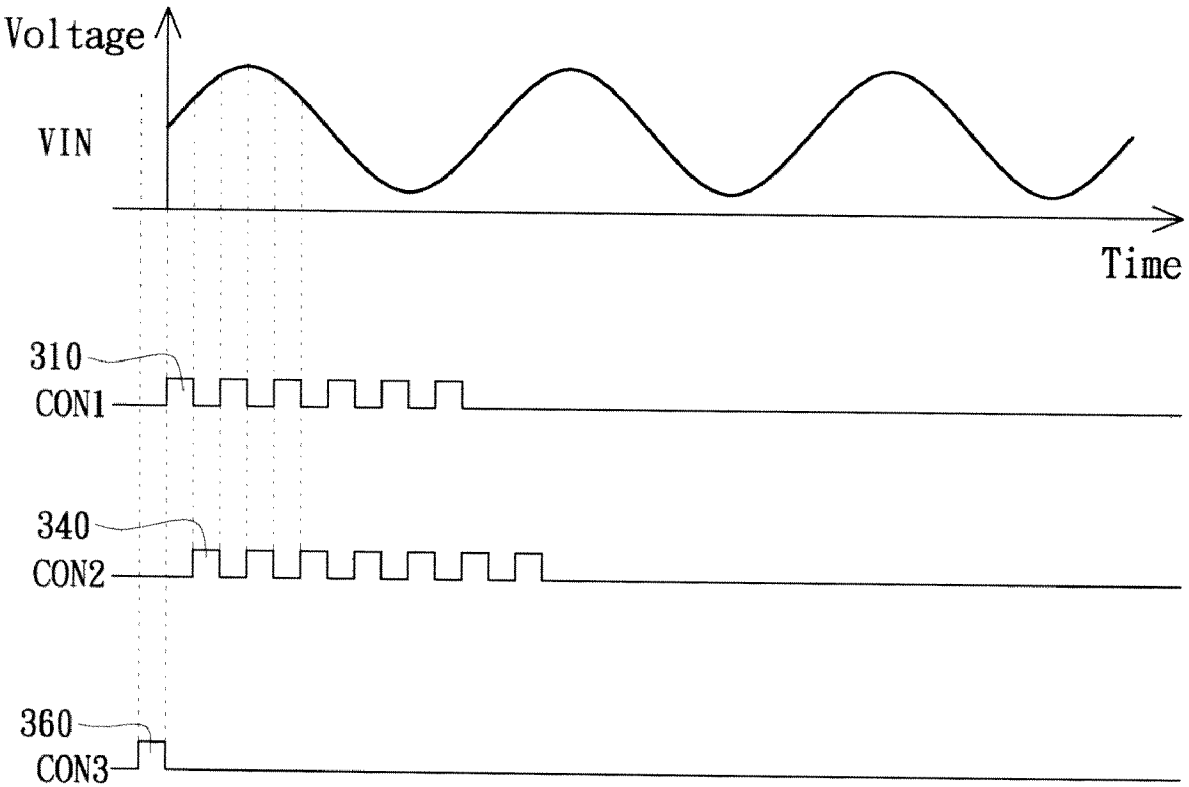
FIG. 3 illustrates a waveform diagram according to the embodiment of the present invention.

The first switch SW1 and the second switch SW2 are controlled by a first control signal CON1, and the third switch SW3 and the fourth switch SW4 are controlled by a second control signal CON2. When the first control signal CON1 is enabled, the first switch SW1 and the second switch SW2 are conducted (i.e., closed); on the other hand, when the first control signal CON1 is not enabled the aforementioned switches SW1 and SW2 are not conducted (i.e., opened). When the second control signal CON2 is enabled, the third switch SW3 and the fourth switch SW4 are conducted or closed with the aforementioned switches SW3 and SW4 opened when the second control signal CON2 is not enabled. The waveforms of the first control signal CON1 and the second control signal CON2 are illustrated in FIG. 3, in which a waveform diagram of the embodiment according to the present invention is presented. Please refer to both FIG. 2 and FIG. 3, when the operation of integration is performed, the first control signal CON1 is used to control the sampling rate (frequency). Every time the first control signal CON1 is enabled as shown in Waveform 310, the voltage of the input signal VIN is stored in the first capacitor C1 and the storing of the voltage of the input signal VIN may last for a period during which the first control signal CON1 is enabled. As the first control signal CON1 is enabled, the second control signal CON2 is disabled. After the first control signal CON1 is disabled, the second control signal CON2 will be enabled as shown in waveform 240 so as to allow the charges stored in the first capacitor C1 to be distributed to the second capacitor C2, so that the voltage of the input signal VIN may be stored in the second capacitor C2.

As the second control signal CON2 is enabled, the third switch SW3 and the fourth switch SW4 are conducted or closed. Therefore, the voltage at the third node T3 may be transmitted to the second node T2 so as to boost up a direct current voltage level of the first capacitor C1. Consequently, a voltage differential between two ends of the first capacitor C1 (or the direct current voltage level of the first capacitor C1) may be added to a direct voltage level at the third node T3 before the second control signal CON2 The operation of integration may be performed accordingly as a direct current voltage level at the second capacitor C2 may increase as the result of the enablement of the second control signal CON2. The increase in the direct current voltage level at the second capacitor C2 is considered as a compressed value of the input signal VIN and is proportional to a ratio of the first capacitor C1 over the second capacitor C2. Assume C1 represents the capacitance of the first capacitor C1 and C2 represents the capacitance of the second capacitor C2. After the first control signal CON1 is enabled, a total amount of charges (Q) stored inside in the capacitor C1 is illustrated in equation (1), and after the second control signal CON2 is enabled, the increase in the direct current voltage level of the second capacitor C2 may be represented in the following equation (2):

$$Q = C1 \times V1 = C2 \times V1' \quad (1)$$

$$V1' = \frac{C1}{C2} \times V1 \quad (2)$$

Therein, in the aforementioned equations, V1 represents the voltage value of the input signal VIN, while the input signal VIN is obtained, V1' represents an increase in a direct current voltage level at the third node T3 after distribution of the charges (i.e., after the second control signal CON2 is enabled). In other words, the direct current voltage level at the third node T3 may increase because of the distribution of charges and V1' represents the increase. By controlling a time sequence of the first control signal CON1, the input signal VIN may be sampled accordingly. And by controlling a time sequence of the second control signal CON2, the charges will be redistributed to the second capacitor C2, increasing the direct current voltage level at the third node T3 to ensure the operation of integration may be accomplished. When the input signal VIN is of a negative value (i.e., V1 is negative), the increase in the direct current voltage level at the third node T3 may be negative as well. In other words, a voltage difference across the two terminals of the second capacitor C2 decreases, which also accomplishes the operation of integration.

In addition, in the embodiment, the capacitance of the first capacitor C1 is smaller than the capacitance of the second capacitor C2. For example, 100C1=C2. As such, the second capacitor C2 may not cause an excessive voltage that falls outside an operating region of a circuit with the integrator circuit 200 of the present invention as the result of the operation of integration.

Moreover, the fifth switch SW5 can be used to reset the integrator circuit 200. While the third control signal CON3 is enabled, please refer to the waveform 360 in FIG. 3, the charges stored in the second capacitor C2 may be transmitted to the ground terminal GNU so as to reset the integrator circuit 200. Therefore, before the performance of the operation of integration, the third control signal CON3 may be enabled to reset the direct current voltage level at the third node T3.

In the output buffer unit 150, the second unit gain amplifier GA2 may transmit the direct current voltage level at the third node T3 to the third capacitor C3, and the sixth switch SW6 is used to maintain the charges stored in the third capacitor C3 so as to avoid leakage current. The third unit gain amplifier GA3 outputs a result of the operation of integration to the output terminal TOUT so as to generate the output signal VOUT. The output signal VOUT is proportional (i.e., the ratio of the capacitance of the first capacitor C1 over the capacitance of the second capacitor C2) to the result of the operation of integration for the input signal VIN.

In summary, the principle of charge distribution of capacitors is applied to realize the low frequency integrator circuit in the present invention. The integrator circuit may compress, and store the sampled voltage into the capacitors, thereby enhancing the linearity of the integrator circuit. Furthermore, in the present invention, the operation of integration may be implemented in the absence of the ADC, so that the manufacturing cost of the entire circuitry may be reduced and an operation of integration of better accuracy may be achieved.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. An integrator circuit, comprising:

a first energy storage component, coupled between a first node and a second node;

a first switching unit, coupled to the first node, an input terminal, the second node, and a ground terminal, for selectively electrically connecting the first node to the input terminal and selectively electrically connecting the second node to the ground terminal;

a second switching unit, coupled to the first node, the second node, and a third node, for selectively electrically connecting the first node to the third node and selectively transmitting a voltage at the third node to the second node; and a second energy storage component coupled between the third node and the ground terminal.

2. The integrator circuit according to claim 1, wherein when the first switching unit electrically connects the first node to the input terminal and electrically connects the second node to the ground terminal, the second switching unit disconnects the first node from the third node.

3. The integrator circuit according to claim 1, wherein when the second switching unit electrically connects the first node to the third node and transmits the voltage at the third node to the second node, the first switching unit disconnects the first node from the input terminal and disconnects the second node from the ground terminal.

4. The integrator circuit according to claim 1, wherein the first switching unit further comprises:

a first switch coupled between the first node and the input terminal; and a second switch coupled between the second node and the ground terminal.

5. The integrator circuit according to claim 4, wherein the second switching unit further comprises:

a third switch, coupled between the first node and the third node;

a first unit gain amplifier having an input coupled to the first node; and a fourth switch coupled between the output of the first unit gain amplifier and the second node;

wherein the first switch and the second switch are controlled according to a first control signal, the third switch and the fourth switch are controlled according to a second control signal.

6. The integrator circuit according to claim 5, wherein when the first control signal is enabled the second control signal is disabled.

7. The integrator circuit according to claim 1, wherein the second switching unit further comprises:

a third switch coupled between the first node and the third node;

a first unit gain amplifier having an input coupled to the first node; and a fourth switch, coupled between the output of the first unit gain amplifier and the second node.

8. The integrator circuit according to claim 1 further comprising a fifth switch coupled between the third node and the ground terminal.

9. The integrator circuit according to claim 1, wherein the first energy storage component is a first capacitor, the second energy storage component is a second capacitor, and a capacitance of the first capacitor is smaller than a capacitance of the second capacitor.

10. The integrator circuit according to claim 1 further comprising:

an output buffer unit, coupled between the third node and an output terminal, comprising:

a second unit gain amplifier having an input coupled to the third node;

a sixth switch having a terminal coupled to the output of the second unit gain amplifier;

a third unit gain amplifier having an input coupled to another terminal of the sixth switch and having an output coupled to the output terminal; and a third capacitor coupled between the input of the third unit gain amplifier and the ground terminal.

* * * * *